US011653759B2

(12) United States Patent
Herzberg et al.

(10) Patent No.: US 11,653,759 B2
(45) **Date of Patent: *May 23, 2023**

(54) CONTAINER FOR A ROAD PAVER ASSEMBLY

(71) Applicant: JOSEPH VOEGELE AG, Ludwigshafen/Rhein (DE)

(72) Inventors: Ingo Herzberg, Angelbachtal (DE); Dennis Hanfland, Speyer (DE); Jens Holfelder, Ludwigshafen (DE); Christian Jenewein, Mannheim (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/583,518

(22) Filed: Jan. 25, 2022

(65) Prior Publication Data

US 2022/0142360 A1 May 12, 2022

Related U.S. Application Data

(63) Continuation of application No. 16/043,885, filed on Jul. 24, 2018, now Pat. No. 11,266,236.

(30) Foreign Application Priority Data

Jul. 25, 2017 (DE) ..... 202017104434.3

(51) Int. Cl.
*A47B 81/00* (2006.01)
*B65D 19/06* (2006.01)
(Continued)

(52) U.S. Cl.
CPC ..... *A47B 81/00* (2013.01); *B25H 3/00* (2013.01); *B25H 3/02* (2013.01); *B65D 19/06* (2013.01);
(Continued)

(58) Field of Classification Search
CPC ..... A47B 81/00; A47B 81/005; A47B 81/007; A47B 2200/0075; A47B 2200/0077;
(Continued)

(56) References Cited

U.S. PATENT DOCUMENTS 1,334,545 A 3/1920 Londelius, Jr.
1,661,121 A 2/1928 Huson
(Continued)

FOREIGN PATENT DOCUMENTS

CA 2 636 974 A1 3/2009
CH 446171 A 10/1967
(Continued)

OTHER PUBLICATIONS

German Search Report dated Feb. 21, 2018, Application No. 20 2017 104 434.3, Applicant Joseph Voegele AG, 5 Pages.
(Continued)

*Primary Examiner* — Andrew M Roersma
(74) *Attorney, Agent, or Firm* — Brooks Kushman P.C.

(57) ABSTRACT

The disclosure refers to a container for storing and providing at least one modular road paver assembly designed for detachable mounting on a road paver. The container comprises a storage system by means of which individual components of the road paver assembly can be positioned within the container in a standardized arrangement, such that the components of the road paver assembly can be checked for completeness by an operator by means of a visual inspection along a sequence determined between opposite boundaries of the container in view of their assembly sequence on the road paver.

20 Claims, 6 Drawing Sheets

(51) Int. Cl.

| | |
|---|---|
| ***B25H 3/00*** | (2006.01) |
| ***E01C 19/48*** | (2006.01) |
| ***B25H 3/02*** | (2006.01) |
| ***B65D 85/68*** | (2006.01) |
| ***E01C 23/01*** | (2006.01) |
| ***E01C 19/00*** | (2006.01) |

(52) U.S. Cl.

CPC ..... *B65D 85/68* (2013.01); *E01C 19/48* (2013.01); *E01C 23/01* (2013.01); *A47B 2220/0077* (2013.01); *B65D 2519/0081* (2013.01); *B65D 2519/00273* (2013.01); *B65D 2519/00323* (2013.01); *B65D 2519/00338* (2013.01); *B65D 2519/00497* (2013.01); *B65D 2519/00502* (2013.01); *B65D 2519/00582* (2013.01); *B65D 2519/00641* (2013.01); *B65D 2519/00716* (2013.01); *B65D 2519/00741* (2013.01); *B65D 2519/00786* (2013.01); *B65D 2519/00796* (2013.01); *B65D 2519/00805* (2013.01); *B65D 2519/00965* (2013.01); *B65D 2519/00995* (2013.01); *B65D 2585/6875* (2013.01); *E01C 19/00* (2013.01); *E01C 2301/14* (2013.01)

(58) Field of Classification Search

CPC . B25H 3/00; E01C 19/00; E01C 23/01; E01C 2301/14; B65D 19/06; B65D 2585/6875; B65D 2585/6882; B65D 2585/6887; B65D 2585/6897

USPC ..... 211/60.1–70.8; 206/372, 373

See application file for complete search history.

(56) References Cited

U.S. PATENT DOCUMENTS

| | | | |
|---|---|---|---|
| 1,719,283 | A | 7/1929 | Zeller |
| 2,606,805 | A | 8/1952 | Willis |
| 3,165,205 | A | 1/1965 | Travis, Jr. |
| 3,590,752 | A | 7/1971 | De Pew |
| 3,684,101 | A | 8/1972 | Bradford et al. |
| 3,895,726 | A | 7/1975 | Rassieur |
| 4,332,007 | A | 5/1982 | Gibstein et al. |
| 4,339,064 | A | 7/1982 | Ziaylek, Jr. |
| 4,760,985 | A | 8/1988 | Stewart et al. |
| 4,921,100 | A | 5/1990 | Krause |
| 5,032,957 | A | 7/1991 | Canfield |
| 6,123,208 | A | 9/2000 | Haenszel |
| 6,598,756 | B1 | 7/2003 | Rosenfeldt |
| 7,316,522 | B2 | 1/2008 | Guntert, Jr. et al. |
| 9,051,696 | B1 | 6/2015 | Coats et al. |
| 9,540,778 | B2 | 1/2017 | Rutz et al. |
| 11,266,236 | B2 * | 3/2022 | Herzberg ..... E01C 23/01 |
| 2005/0016943 | A1 | 1/2005 | Dick |
| 2009/0078665 | A1 | 3/2009 | Sandusky et al. |
| 2009/0311065 | A1 | 12/2009 | Gaudette |
| 2010/0256878 | A1 | 10/2010 | Zegowitz |
| 2013/0001179 | A1 | 1/2013 | Harpole |
| 2014/0341672 | A1 | 11/2014 | Gaudette |
| 2015/0090681 | A1 | 4/2015 | Olivier |
| 2015/0209954 | A1 | 7/2015 | Hokanson |
| 2016/0264291 | A1 | 9/2016 | Hansen |
| 2017/0015481 | A1 | 1/2017 | Bradfrod |
| 2017/0020283 | A1 | 1/2017 | Hokanson |
| 2017/0174422 | A1 | 6/2017 | Schomaker et al. |

FOREIGN PATENT DOCUMENTS

| | | | |
|---|---|---|---|
| CN | 205874927 | U | 1/2017 |
| CN | 205989314 | U | 3/2017 |
| CN | 209097418 | U | 7/2019 |
| DE | 19504798 | A1 | 8/1996 |
| DE | 10 2014 207 572 | A1 | 10/2015 |
| DE | 20 2016 101 874 | U1 | 6/2016 |
| DE | 10 2015 016 672 | A1 | 6/2017 |
| EP | 1375318 | A2 | 1/2004 |
| EP | 2 239 374 | A1 | 10/2010 |
| EP | 2 547 595 | B1 | 8/2017 |
| FR | 2619295 | A1 | 2/1989 |
| FR | 2625519 | A1 | 7/1989 |
| GB | 1069122 | A | 5/1967 |
| JP | H0510030 | A | 1/1993 |
| JP | H0731964 | U | 6/1995 |
| JP | H0885914 | A | 4/1996 |
| JP | 09202237 | A | 8/1997 |
| JP | 2002257110 | A | 9/2002 |
| JP | 2003512979 | A | 4/2003 |
| JP | 2014077322 | A | 5/2014 |
| JP | 2014206044 | A | 10/2014 |
| JP | 3210364 | U | 5/2017 |
| WO | 2013020166 | A1 | 2/2013 |

OTHER PUBLICATIONS

Extended European Search Report dated Dec. 19, 2018, Application No. 18183352.6-1019, Applicant Joseph Voegele AG, 8 Pages.

Japanese Office Action dated Jun. 11, 2019, Application No. 2018-138287, 5 Pages.

Indian Examination Report dated Jan. 20, 2020, Application No. 201814027583, Applicant Joseph Voegele AG, 6 Pages.

Chinese First Office Action dated Jun. 24, 2020 (with English Translation), Application No. 201810830355.1, Applicant Joseph Fu Gele Company, 16 Pages.

* cited by examiner

CONTAINER FOR A ROAD PAVER ASSEMBLY

CROSS-REFERENCE TO RELATED APPLICATIONS

This application is a continuation of U.S. application Ser. No. 16/043,885, filed Jul. 24, 2018, which claims foreign priority benefits under 35 U.S.C. § 119(a)-(d) to German patent application number DE 20 2017 104 434.3, filed Jul. 25, 2017, each of which is incorporated by reference in its entirety.

TECHNICAL FIELD

The present disclosure relates to a container for storing and providing at least one modular road paver assembly designed for detachable mounting on a road paver in accordance with claim 1.

BACKGROUND

Known road pavers are adapted to produce new road surfaces. Such road pavers comprise a material bunker for receiving paving material, a longitudinal conveyor system which transports the paving material out of the material bunker against the direction of paving and feeds it to a cross-feeding auger attached to the rear of the paver's chassis, which spreads the paving material in front of a pulled-behind paving screed attached to the road paver. The paving screed is equipped with heating and compaction units that compact the paving material into a new layer of road pavement.

It is also known that modular assemblies are used on conventional road pavers for specific applications. For example, a measuring beam device assembled as a module can be attached to a road paver, and the paving screed can be levelled on the basis of these measurements. Such a measuring beam device comprises a large number of assembled components which can be attached to the road paver as a whole. It is also known that modular extensions can be fitted to the screed depending on the pave width to be produced. The optional attachable modules make the road paver extremely versatile.

In practice, however, the storage, provision of the components belonging to a module, their transport and their proper installation on the road paver proved to be problematic. In particular, it is difficult to keep all associated components of such road paver modules completely together over a long period of time, to protect them sufficiently, to enable simple assembly and to make them reliably available for use on different construction sites. Another problem is that even the lack of individual components of a road paver assembly can lead to a delay on the construction site. However, the resulting downtimes inflate production costs.

SUMMARY

The disclosure is thus based on the object of improving the storage and provision of a modular road paver assembly designed for detachable installation on a road paver.

The disclosure refers to a container for storing and providing at least one modular road paver assembly designed for detachable mounting on a road paver. The container comprises a storage system which allows individual components of the road paver assembly to be positioned within the container in a standardised arrangement.

According to the disclosure, the storage system designs the standardized arrangement in such a way that the respective components of the road paver assembly can be visually inspected for completeness by an operator along an order determined between opposite boundaries of the container in view of their assembly sequence on the road paver.

According to the disclosure, there is therefore a direct connection between the standardized arrangement of individual components of the road paver assembly within the container and their assembly sequence on the road paver, which helps the operator to easily check whether the respective components of the road paver assembly are completely stored and provided in the container. The main advantage for the operator here is that he can see more easily against the mental background of the assembly sequence whether individual components of the road paver assembly are missing in the container storage system, for which case he could act quickly to prevent delays on the construction site.

In particular, an advantage provided by the disclosure is that it may be immediately visible in advance, i.e., before the road paver assembly is attached to the road paver, whether it is complete for use. In other words, uncontrolled assembly can be prevented. In particular, untrained personnel can benefit from the container system according to the disclosure, as a proper installation of the components made available in it on the road paver is easily possible even without routine.

In the container, add-on parts can be arranged in groups according to their intended use. It is possible to arrange the respective add-on parts grouped in the container in such a way that they can be easily identified individually due to their positioning relative to each other, but also as bundles, i.e., as modules that functionally belong together. It is conceivable that the completeness of the respective grouped add-on parts can be checked by means of RFID technology, for example with the aid of an RFID transponder reading system. According to a variant, a container, in particular the bundles (add-on parts and/or groups) accommodated therein, can be clearly assigned to predetermined process parameters, primarily a working width, a type of tractor unit and/or a type of screed. This means that the respective containers can be used for the appropriate purpose. Consequently, it is possible to send the right containers, i.e., loaded with the right components, to the right construction site for a specific purpose.

Preferably, the container contains fasteners for the respective add-on parts, which can be used to attach them to the road paver or feeder at the operation site. These are, for example, screws, washers, quick-release fasteners or similar fasteners.

The connection between the standardized arrangement of individual components and their assembly sequence on the road paver also makes it particularly advantageous that the modular road paver assembly, which can be assembled from the individual components, remains complete in the container so that the container, together with its stored road paver assembly, can be reliably used on different construction sites. The main reason for this is that the inventive concept is advantageous not only for the initial control of the completeness of the road paver assembly in the container, but also with regard to its removal sequence and its placement order. As a result, the container system according to the disclosure can remain complete, clean and fully operational in the long term.

The container according to the disclosure also reduces the risk of individual components of the road paver assembly being lost. Their standardized, predetermined arrangement in the storage system apparently signals whether all components of the road paver assembly have been moved to their intended storage location in the container after use. The absence of a component can be easily detected from a gap in the storage system.

Functional assemblies are considered as road paver assemblies for use in the disclosure, which can be attached to the road paver as modules comprising several components that can be assembled or mounted on the road paver according to a specific assembly plan and which, if their use is no longer required, can be dismantled step by step by the road paver. Such add-on modules make it possible to retrofit the road paver for special applications without having these functional modules in its standard version.

Optional attachable road paver modules for storage and provision by means of the container according to the disclosure would include, for example, a measuring beam device, a docking assembly intended for a loading process, components for producing the working width, for example widening modules for the paving screed, material bunker installation modules for improving the mixing of the paving material, add-on modules for night work, in particular lighting units for attachment to the road paver, spreading auger modules for optional widening of the sideways directed material transport in front of the screed and/or a thermography module for generating and processing individual measured values of the newly paved layer in question.

Standardized arrangement of individual components of the road paver assembly means that their arrangement in the storage system is not arbitrary, but that a special space is provided for each component. The individual components can therefore always be found at the right place at the right time.

Preferably, the storage system defines the standardized arrangement at least in part as an assembly plan by positioning the individual components of the road paver assembly for removal from the container according to the predetermined assembly sequence for their attachment to the road paver. This allows the individual components of the road paver assembly to be removed from the container in sequence so that they can be mounted directly on the road paver for attachment to the road paver. This prevents individual components from being taken out of the container without any plan and then first deposited on the ground before being mounted on the paver, because they were removed from the container contrary to the predetermined assembly sequence. This is particularly undesirable with sensitive, costly sensor units. The storage system not only ensures that order is created within the container, but also provides assistance in ensuring that the respective components are removed from the container in the correct order for assembly on the road paver, so that they can be continuously mounted on the road paver. In other words, the placement of the respective components of the road paver assembly within the container is selected in such a way that it determines the order in which the respective components are to be removed from the road paver, i.e., visually indicates to the operating personnel which order of attachment is to be carried out so that the respective components are properly attached to the road paver. Conversely, the standardized placement of the respective storage locations within the container can also assist the operating personnel in dismantling the respective components from the road paver in order to properly secure them back in the container.

It is particularly easy to understand when the storage system positions the individual components of the road paver assembly inside the container in ascending or descending order for removal and/or the storage system arranges the individual components of the road paver assembly next to each other in the container in such a way that the respective components are provided along a direction determined between opposite side walls of the container for removal. The operator who removes the individual components of the road paver assembly from the container or in turn places them in the container is thus given a direction of removal or placement that corresponds to the order of placement of the individual components on the road paver (when placing them in the opposite direction). In other words, the component to be removed first from the container is mounted on the road paver first or the first component to be removed by the paver first is put back into the container against the direction of removal.

The operator in particular benefits from this design because an assembly master plan is already given to him in view of the arrangement of the individual components in the storage system of the container. When the components are put away, the storage system, its structure and the direction in which they are to be put away, also informs him where the respective components are to be properly stored in the container.

The storage system is preferably designed to accommodate a measuring beam device, an add-on module and/or components for producing the working width of the paving screed, in particular extension parts for a paving screed of the road paver within the container, as a modular paver assembly. Alignment of the standardized arrangement of the individual components in the container with their assembly sequence on the road paver offers considerable advantages for their step-by-step installation on the road paver.

The individual components of the road paver assembly in the container can be made available in a particularly clear manner by the fact that the storage system is configured as a shelf unit. This also offers advantages with regard to the compact design of the container.

Advantageously, the storage system has a plurality of profile plates for supporting the respective components of the road paver assembly. These are easy to produce and contribute little to the total weight of the container. In addition, the profile plates can be arranged inside the container in such a way that they also give it stability. The respective profile plates are preferably detachably fastened in the container and can be replaced or supplemented by other profile plates depending on the road paver assembly to be transported, so that the storage system, i.e., the "inner workings" of the container, can be easily converted or retrofitted.

Preferably, a plurality of receptacles are formed in the respective profile plates, whose respective shape is essentially adapted to a cross-section of a component to be accommodated therein. This allows the components to be safely stored in the container for transport.

The individual components of the road paver assembly can preferably be locked to the storage system without tools. In particular, the individual components can be stored without tools and/or removed from the storage system without tools. This saves time when stocking and clearing out the container and also ensures that the individual components are secured for transport in the container.

To simplify the container construction, individual components and/or sub-assemblies of the modular road paver assembly may be fixed by their own weight in the storage places provided for them at least in one direction within the container. For this purpose, for example, form-fitting supports could be formed within the container, into which bearing projections of the respective components can engage. Spring steel locks can be used to fix individual components, especially parts of the screed, such as screed extensions. With the aid of spring steel locks, individual components, add-on parts and/or assemblies in particular can be fastened to the container ground in a non-slip manner.

It is particularly advantageous if the container is accessible from at least one side wall, in particular from a longitudinal side wall, in order to remove and store long components of the road paver assembly. From there, it is also easy to check whether the road paver assembly is fully loaded into the container.

It is particularly advantageous if all stored components are directly accessible and visibly positioned in the storage system. In other words, the handling of a component does not depend on another component.

A practical option is for the container to have a fixed roof. For the individual components accommodated therein, the fixed roof offers an excellent protective function, in particular weather protection, whether during transport of the container on a truck or while it is on the construction site.

One variant provides that the container is open from below or has openings. Even if individual or several components of the road paver assembly are stored wet in the container, moisture can escape from the container through the open bottom in some places. Thus the inside of the container can be kept reliably dry. It would also be conceivable to form the bottom of the container with a slight slope so that reliable drainage can take place. As a result, adhesive or stowage water can be easily removed from the container.

The container can be designed to be stackable for logistical purposes. Individual containers can thus be placed one on top of the other on the construction site and/or in the warehouse to save space. Preferably, the container is designed for forklift transport. For this purpose, it can have at least one levelling aid for engaging the fork of the forklift on the ground.

According to one embodiment, at least one eyelet is formed on the container, especially on the fixed roof, for lifting the container. The container can thus be easily moved by means of a crane, especially by lifting it from a truck.

Preferably, the container essentially comprises a stand area of one size and shape corresponding to two Euro pallets lying side by side. This makes it easy to transport on a truck.

The container can be designed to be lockable for secure use on the construction site. Preferably, the container is made of lightweight construction. In particular, the outer walls of the container are riveted, so that any paintwork applied to them is not damaged.

According to one variant, the container has at least one lighting unit for illuminating the storage system. This is particularly useful for night work on the construction site. It would also be useful for controlled handling at night if the lighting unit was configured to illuminate the respective components of the road paver assembly stored in the storage system in sequence according to their order of installation on the road paver. For example, an LED assembly installed in a container could be considered.

The container is preferably configured in such a way that manual removal is permitted, especially for small parts and lightweight components. It is also advantageous if the container allows the removal of heavy components, i.e., is accessible from above from the crane hoist. However, heavier components can also be stored in the container in such a way that they can be ergonomically removed from the container by hand.

According to one embodiment, the container is available as a universal package, i.e., it is configured to accommodate a plurality of different road paver assemblies. Alternatively, the container may only be designed to provide a specific road paver assembly, depending on the type of road paver and/or screed.

To provide an improved completeness check, visual placeholders can be provided inside the container so that the site personnel can see at a glance whether the package provided by the container is complete. In particular, it could be provided that places inside the container which must be equipped before work can begin are marked with a predetermined colour code, in particular at least partly in green.

A further visually appealing effect can be achieved if locks for the respective components of the road paver assembly are marked in a signal colour, in particular at least partially in red. The site personnel can thus easily identify where components have to be secured within the container. Furthermore, it can be used to quickly check by means of a simple visual check whether all components are securely locked.

Preferably, locks provided inside the container are self-locking, i.e., the locks are mounted in such a way that they cannot be removed without tools and can therefore be accidentally lost.

The container itself and/or the storage plates detachably attached to it are preferably configured in such a way that individual components and/or road paver attachments, such as screed extensions, can be removed by navigating the road paver. It is conceivable that a screed of the road paver could be lifted and extended sideways in such a way that a lateral screed add-on part would be placed directly on its storage position in the container.

The following figures explain embodiments of the disclosure in more detail.

DETAILED DESCRIPTION

Figure 1:
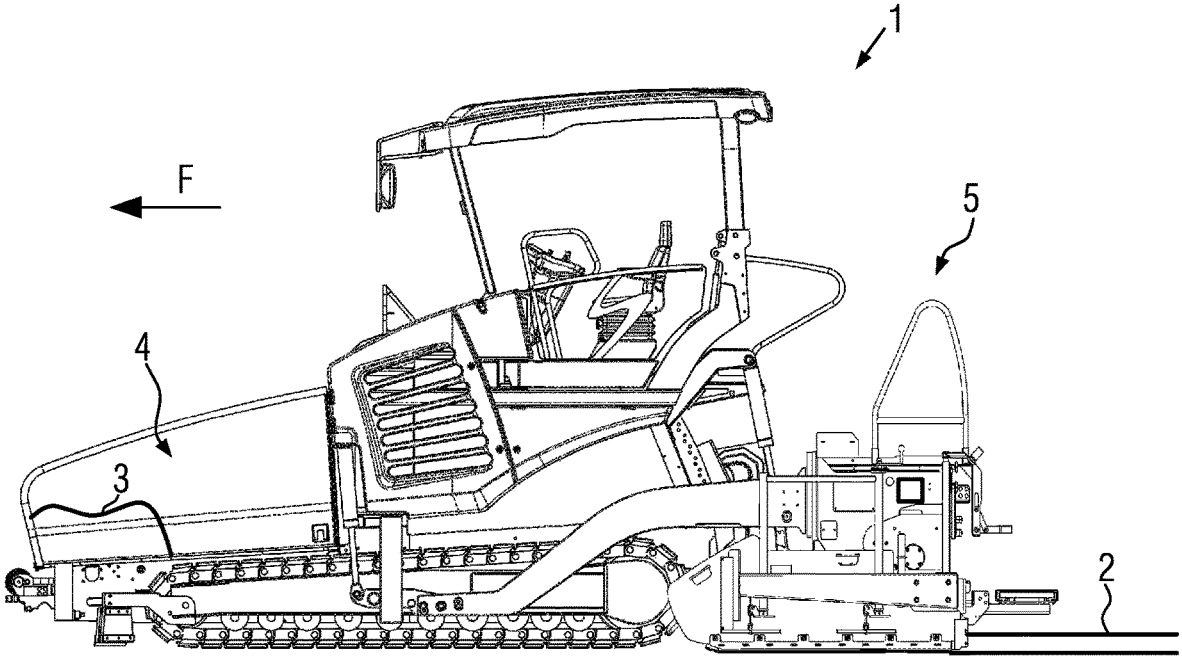
FIG. 1 shows a road paver to which a road paver assembly provided by the container according to the disclosure can be attached.

FIG. 1 shows a road paver 1 for placing a new paving layer 2. The road paver 1 stocks a paving material 3 in a material bunker 4 from which the paving material 3 is conveyed backwards against a direction of travel F to a screed 5 fixed to the road paver 1. Screed 5 is designed to compact paving material 3 into a new layer 2 of road pavement.

Figure 2A:
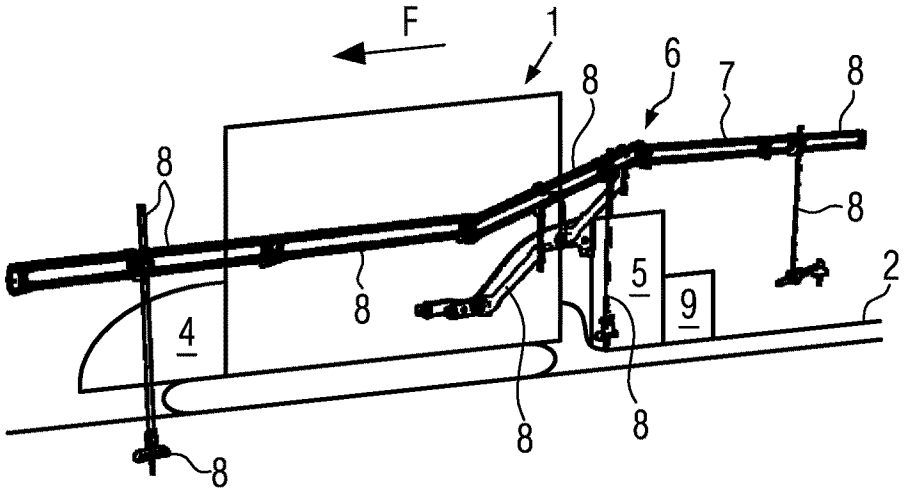
FIG. 2A shows a schematic representation of the road paver from FIG. 1 with a road paver assembly in the form of a measuring beam device, which is modularly attached to it.

FIG. 2A shows the road paver 1 from FIG. 1 in schematic form, including a road paver assembly 6 attached to it, which is designed in accordance with FIG. 2A as a measuring beam device 7, designed in particular for levelling purposes of the screed 5. The measuring beam device 7 comprises a plurality of individual components 8, which are assembled as a module and attached laterally to the road paver 1. FIG. 2A also shows schematically that an add-on module 9 is attached to screed 5. For example, this involves widening the screed.

Figure 2B:
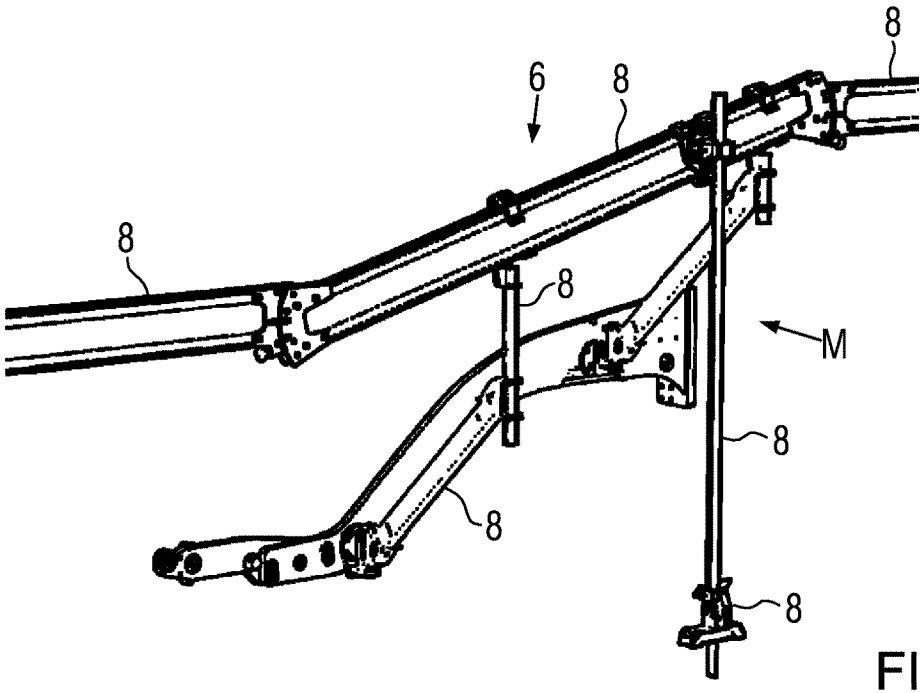
FIG. 2B shows an enlarged representation of individual components of the measuring beam device mounted on the road paver as shown in FIG. 2A.

FIG. 2B shows individual components 8 of the measuring beam device 7 in enlarged, assembled view. All components 8 of the measuring beam device 7 are attached to road paver 1 in accordance with a predetermined installation plan M with regard to their mounting. A mounting sequence for the installation of the individual components 8 can be derived from the assembly plan M of the respective components 8 shown in FIG. 2B.

Figure 3:
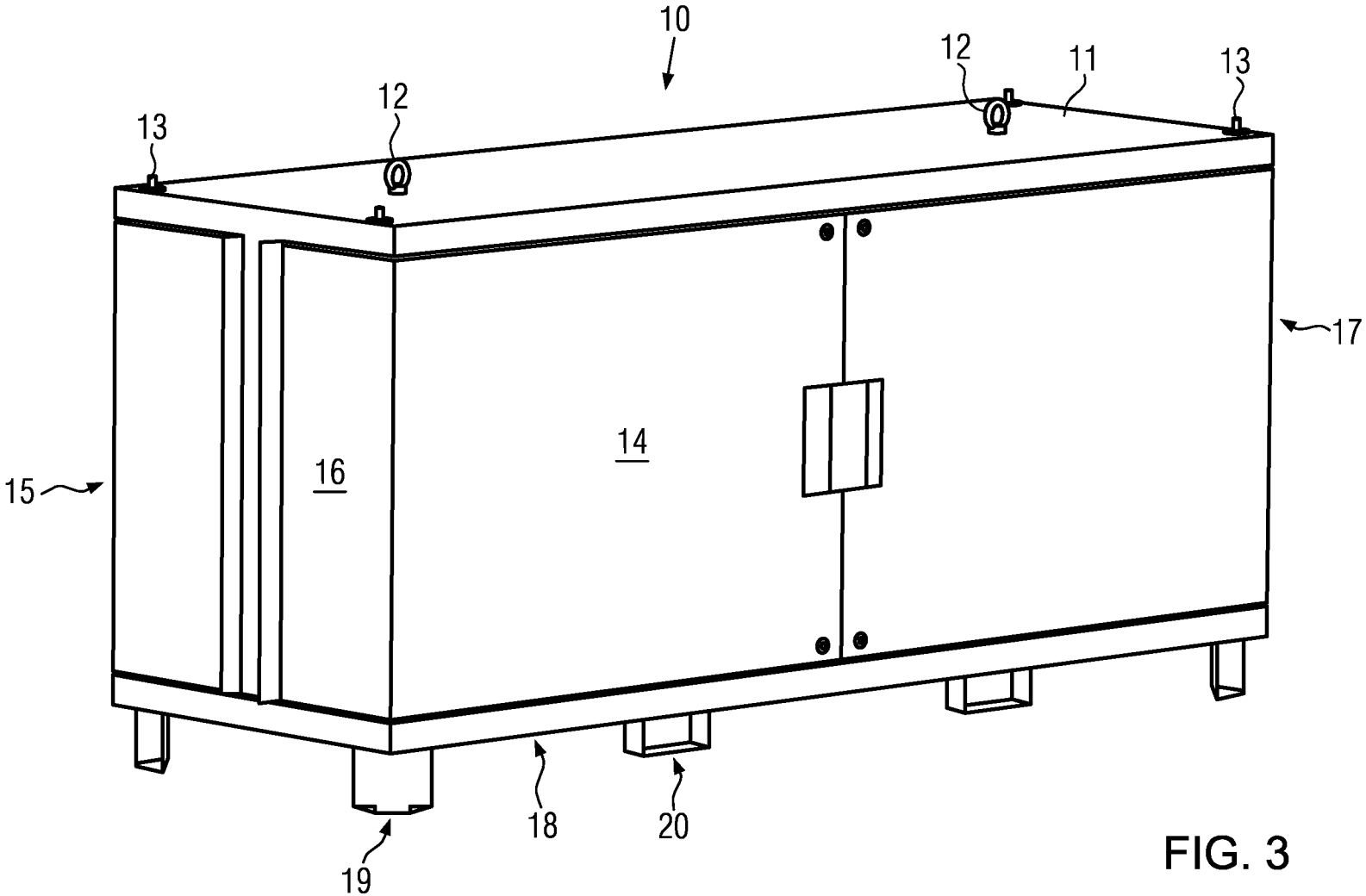
FIG. 3 shows a container for storing and providing a road paver assembly.

FIG. 3 shows a container 10 in perspective view. Container 10 is designed to store and provide at least one modular road paver assembly 6 designed for detachable installation on the road paver 1. Container 10 comprises a lid 11, which is configured as a fixed roof. Two eyelets 12 are attached to cover 11 for lifting the container 10. Furthermore, projections 13 are formed in the respective corner areas of the lid 11, which serve as stacking aids.

FIG. 3 shows the container 10 closed. The container 10 comprises a long side wall 14 and an opposite long side wall 15. The container 10 further comprises a short side wall 16 and an opposite short side wall 17. FIG. 3 also shows that on a bottom 18 of the container 10 there are stacking holders 19 in the respective corner areas, which serve to accommodate the above-mentioned projections 13 of a container 10 arranged below. In addition, transport frame 20 is provided below side panel 14 on the floor, into which a fork of a forklift truck can enter for transporting the container 10.

Figure 4:
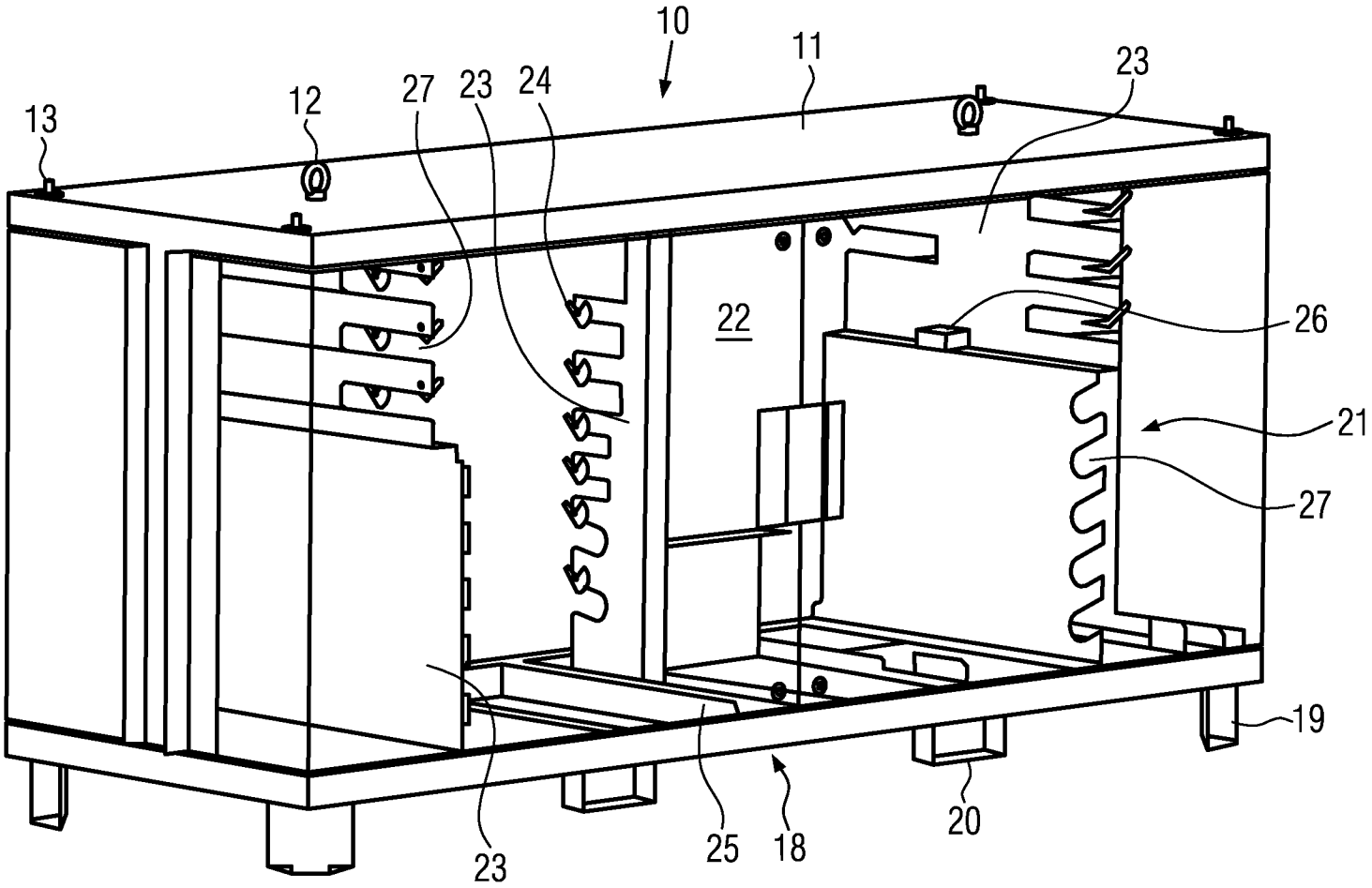
FIG. 4 shows the interior structure of the container as shown in FIG. 3.

FIG. 4 shows an internal structure of container 10. The container 10 has a storage system 21, which is arranged in an interior 22 of container 10. The storage system 21 has profile plates 23 arranged next to each other, which together form a racking unit for the individual components 8 of road paver assembly 6. Several locks 24 are provided on the respective profile plates 23 in order to lock the individual components 8 of road paver assembly 6 to storage system 21. The locks 24 are designed for tool-free operation. The respective profile plates 23 comprise several receptacles 27.

FIG. 4 also shows that the bottom 18 of container 10 is open. For this purpose, the bottom 18 is formed according to FIG. 4 by means of cross struts 25 arranged next to each other. In FIG. 4, the cross struts 25 form a basis for fastening the respective profile plates 23. FIG. 4 also shows a lighting unit 26 for illuminating storage system 21, in particular the components 8 shown in FIGS. 5 and 6.

Parts of the respective side walls 14, 15, 16, 17 shown in FIGS. 3 and 4 can be designed as panellings. In particular, these panellings may be configured so that the respective sides of container 10 can be opened or closed by a total of two U-shaped or, as shown in FIG. 3, by four L-shaped panellings.

Figure 5:
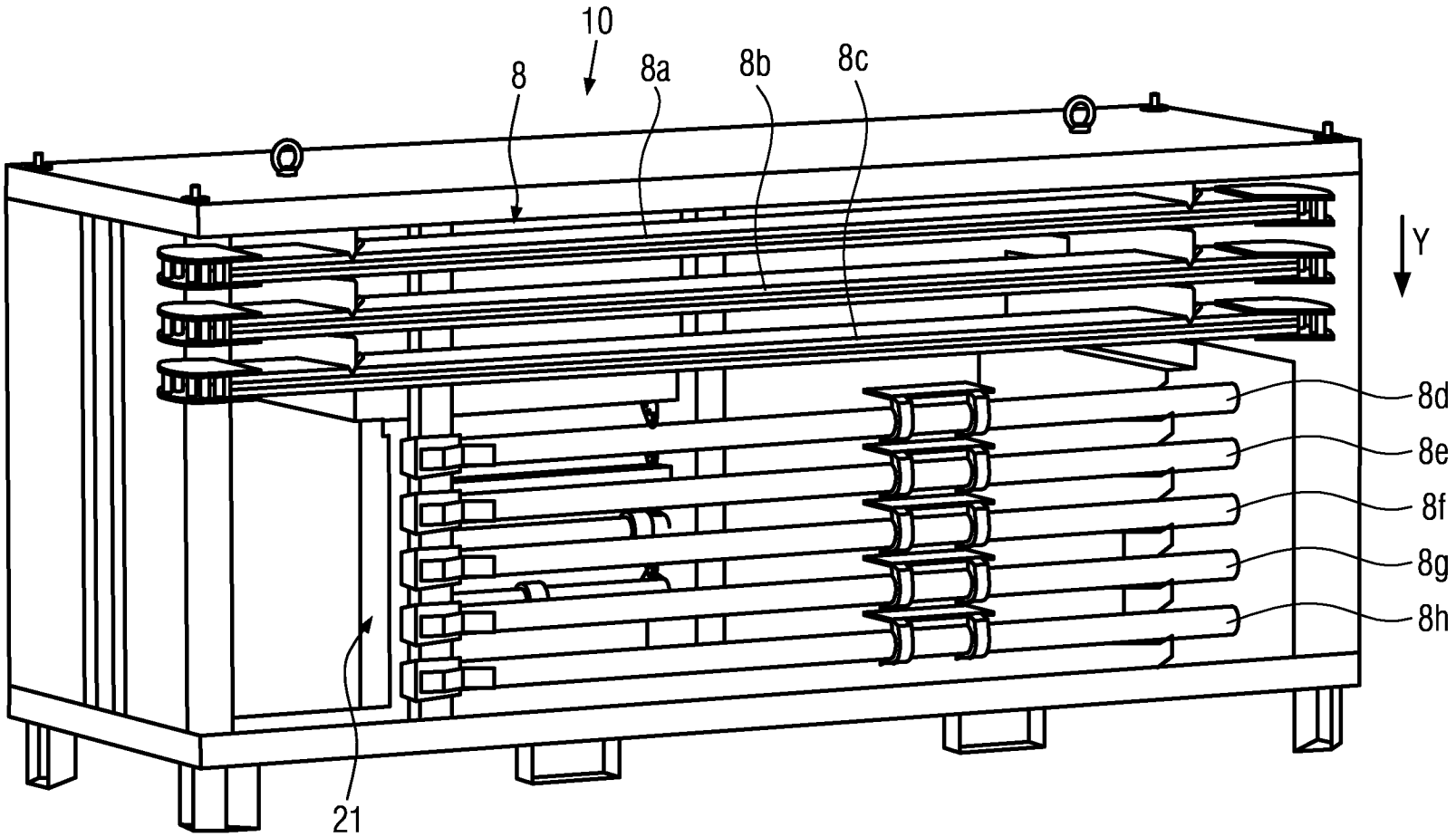
FIG. 5 shows the container with a road paver assembly stored in it from a first side view.

FIG. 5 shows the container 10 shown in FIG. 4, with components 8 of the road paver assembly 6 embedded in the storage system 21, and according to FIG. 5, beam-like components 8 of the beam measuring device 7 shown in FIGS. 2*a* and 2*b* are embedded. However, this serves only to explain the concept according to the disclosure and is not limited to this assembly.

The individual components 8 in FIG. 5 are arranged one above the other in storage system 21 and are positioned in descending direction Y according to their assembly sequence on paver 1, i.e., according to their intended removal from container 1, using a standardized arrangement 8*a* to 8*h*. For mounting or assembling the respective components 8, the operator removes the respective components 8 from storage system 21 one after the other in the (removal) direction Y and attaches the removed components 8 to road paver 1 accordingly. The standardized arrangement 8*a* to 8*h* thus determines the order of assembly sequence on paver 1 in descending direction Y. Alternatively, the storage system 21 for the arrangement of components 8 could be configured to arrange the respective components 8 next to each other so that they are prepared for removal along a direction (X) determined between opposite side walls (14, 15, 16, 17) of the container (10).

Figure 6:
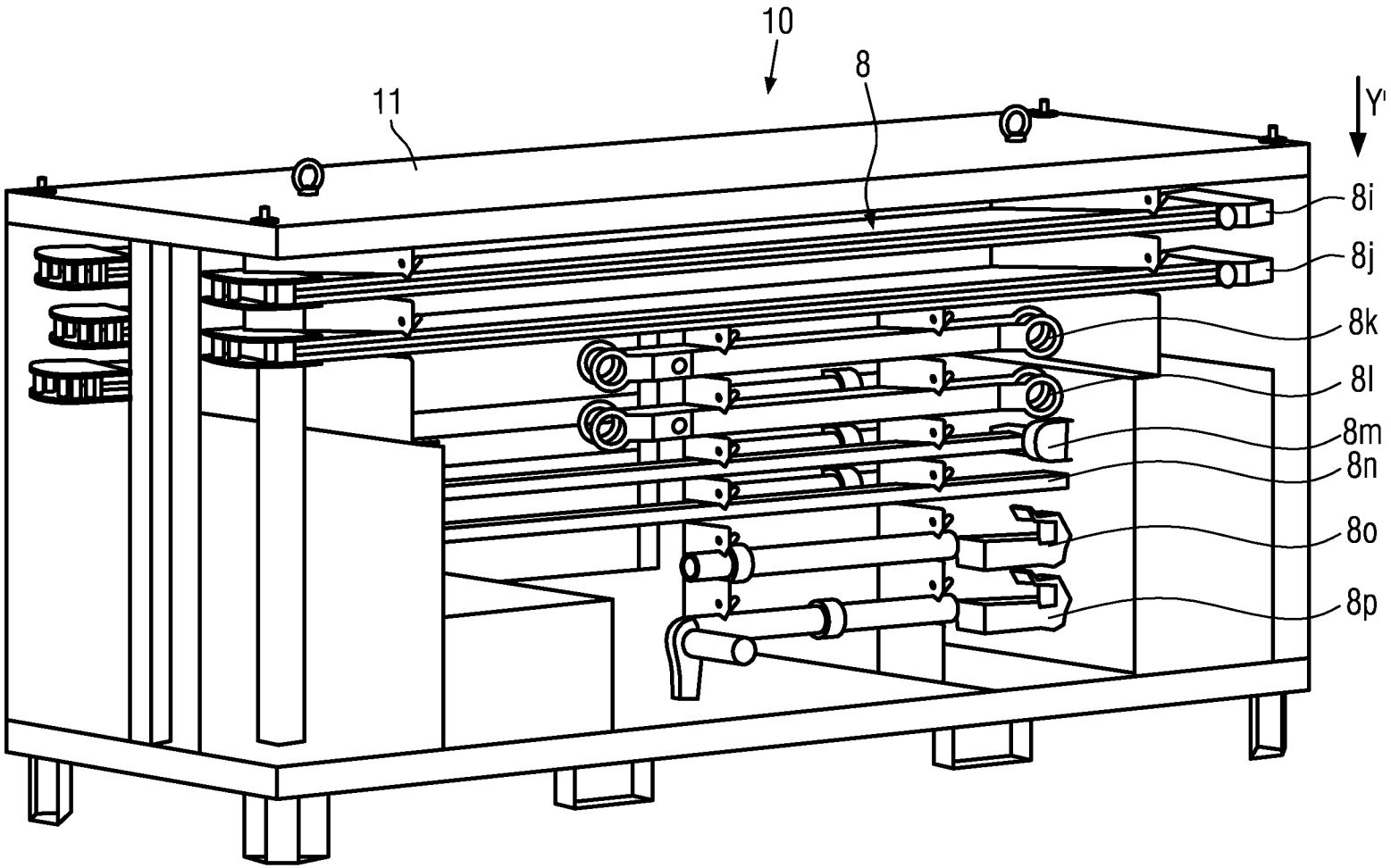
FIG. 6 shows the container with a road paver assembly stored in it from a second side view.

FIG. 6 shows the open container 10 shown in FIG. 5 from behind. The storage system 21 also provides components 8 arranged one above the other on this side of the container 10 for removal in descending direction Y'. Components 8 on this side can form another road paver assembly or associated parts of road paver assembly 6 as shown in FIG. 5. FIG. 6 shows that the individual components 8 can be removed in the descending direction Y' according to a sequence of 8*i* to 8*p* in order to be attached to the paver 1 according to this removal sequence, i.e., to supplement the components 8 previously shown in FIG. 5, if necessary.

The components 8 stored in FIGS. 5 and 6 are intended as an example of a road paver assembly 6 which can be removed from container 10 in accordance with the disclosure, in order to be mounted on road paver 1 one after the other in accordance with their predetermined (removal) direction 8*a* to 8*p*.

The container according to the disclosure is ideal for use on construction sites. It contains an intelligent storage system that simplifies the use of components stored in it. The container can be used to provide road paver assemblies that can be easily mounted on the road paver. In addition, the components accommodated in the container are reliably available in a standardised form for proper use on several construction sites and are accommodated therein in an advantageously protected manner. The container according to the disclosure can be used for the advantageous storage and supply of different road paver assemblies, which are used in a modular manner on the road paver.

What is claimed is:

1. A modular road paver assembly storage arrangement for use with a road paver, the arrangement comprising:

individual components of a modular road paver assembly configured to be detachably mounted on the road paver; and a container including a storage system by which the individual components of the modular road paver assembly are positioned within the container in a standardized arrangement that is based on a predetermined assembly sequence of the individual components on the road paver, wherein the storage system defines the standardized arrangement based on a removal order of the individual components from the container according to the assembly sequence.

2. The arrangement according to claim 1 wherein the storage system is configured to position the individual components of the modular road paver assembly one above the other in ascending or descending direction in view of the assembly sequence.

3. The arrangement according to claim 1 wherein the storage system is configured to arrange the individual components of the modular road paver assembly side by side so that the individual components are provided along a direction between opposite side walls of the container for removal.

4. The arrangement according to claim 1 wherein the container comprises multiple cross struts arranged next to each other at a lower end of the container, and multiple upright profile plates fastened to the cross struts and configured to receive the individual components.

5. The arrangement according to claim 1 wherein the modular road paver assembly comprises a measuring beam device.

6. The arrangement according to claim 1 wherein the modular road paver assembly comprises an add-on module for a paving screed of the road paver.

7. The arrangement according to claim 6 wherein the add-on module is configured to widen the paving screed.

8. The arrangement according to claim 1 wherein the container comprises spring steel locks to fix the individual components to the container.

9. The arrangement according to claim 1 wherein all of the individual components of the modular road paver assembly are positionable in the container so that the individual components are directly accessible and visible in the storage system.

10. The arrangement according to claim 1 wherein the container is configured to accommodate an additional road paver assembly, and wherein the additional road paver assembly is different than the modular road paver assembly.

11. The arrangement according to claim 1 wherein the container comprises color-coded portions to assist a completeness check of the individual components in the container by a visual inspection of the container.

12. A modular road paver assembly storage arrangement for use with a road paver, the arrangement comprising:

individual components of a modular road paver assembly configured to be detachably mounted on the road paver; and a container configured to store the individual components of the modular road paver assembly in a disassembled state, the container comprising a storage system by which the individual components are positioned within the container in a standardized arrangement that is based on a predetermined assembly sequence of the individual components on the road paver, wherein the storage system defines the standardized arrangement based on a removal order of the individual components from the container according to the assembly sequence, the standardized arrangement is configured to be checked for completeness of the individual components by an operator by a visual inspection of the container in view of the assembly sequence, and wherein the storage system comprises a plurality of profile plates for supporting the individual components of the road paver assembly.

13. A method of storing individual components of a modular road paver assembly configured to be detachably mounted on a road paver, the method comprising:

positioning the individual components of the modular road paver assembly in a container, wherein the container includes a storage system by which the individual components are positioned within the container in a standardized arrangement that is based on an assembly sequence of the individual components on the road paver, and wherein the storage system defines the standardized arrangement based on a removal order of the individual components from the container according to the assembly sequence.

14. The method according to claim 13 further comprising transporting the container to a construction site, removing the components from the container, and mounting the components on the road paver at the construction site according to the assembly sequence.

15. The method according to claim 13 further comprising removing the individual components from the container according to the removal order, and mounting the individual components on the road paver to form the modular road paver assembly.

16. The method according to claim 13 wherein the positioning is carried out so that the individual components are positioned in the container one above the other in ascending or descending direction in view of the assembly sequence.

17. The method according to claim 13 wherein the positioning is carried out so that the individual components are positioned in the container side by side such that the individual components are provided along a direction between opposite side walls of the container for removal.

18. The method according to claim 13 wherein the modular road paver assembly comprises a measuring beam device.

19. The method according to claim 13 wherein the modular road paver assembly comprises an add-on module for a paving screed of the road paver.

20. The method according to claim 13 wherein the modular road paver assembly comprises a docking assembly.

* * * * *